US010550626B1

(12) United States Patent
Medina et al.

(10) Patent No.: US 10,550,626 B1
(45) Date of Patent: Feb. 4, 2020

(54) METAL FRAME AND GLASS PANE DOOR ELEMENT, WINDOW ELEMENT, SYSTEMS INCLUDING SAME, AND METHOD FOR MAKING SAME

(71) Applicant: Portella Industries, LLC, Austin, TX (US)

(72) Inventors: Martha Medina, Austin, TX (US); Misrraim Cardenas Salmeron, Cedar Park, TX (US); Alejandro Salazar Salas, San Nicolas de Los (MX)

(73) Assignee: Portella Industries, LLC, Austin, TX (US)

( * ) Notice: Subject to any disclaimer, the term of this patent is extended or adjusted under 35 U.S.C. 154(b) by 0 days.

(21) Appl. No.: 16/206,259

(22) Filed: Nov. 30, 2018

(51) Int. Cl.

| | |
|---|---|
| ***E06B 3/12*** | (2006.01) |
| ***E06B 3/54*** | (2006.01) |
| ***E06B 3/24*** | (2006.01) |
| ***E06B 3/58*** | (2006.01) |
| ***E06B 3/263*** | (2006.01) |

(52) U.S. Cl.
CPC ..... *E06B 3/549* (2013.01); *E06B 3/12* (2013.01); *E06B 3/24* (2013.01); *E06B 3/263* (2013.01); *E06B 3/5814* (2013.01); *E06B 3/5892* (2013.01)

(58) Field of Classification Search
CPC .. E06B 3/549; E06B 3/26301; E06B 3/26305; E06B 3/26303; E06B 3/5814; E06B 3/605; E06B 3/5892; E06B 2003/26309
See application file for complete search history.

(56) References Cited

U.S. PATENT DOCUMENTS 3,191,727 A * 6/1965 Schmeltz ..... E06B 3/26301 24/DIG. 50
3,760,543 A * 9/1973 McAllister ..... E06B 3/5892 52/204.591

(Continued)

FOREIGN PATENT DOCUMENTS

EP 1647661 A1 * 4/2006 ..... E06B 3/5892
WO WO-0159244 A1 * 8/2001 ..... E06B 3/26301
WO WO-2013186887 A1 * 12/2013 ..... E06B 1/6061

*Primary Examiner* — Christine T Cajilig
(74) *Attorney, Agent, or Firm* — Hunt Pennington Kumar & Dula, pllc

(57) ABSTRACT

An element, having an insulating glass unit mounted in a metal frame assembly, may include an outer frame assembly comprising a unitary outer frame member, a plurality of mounting studs projecting from said outer frame member in perpendicular relationship in a first pattern aligned with a first complementary pattern of mounting bores defined in an insulation body assembly when the outer frame member is disposed in common alignment with the insulation body assembly, an inner frame assembly including a multi-part inner frame member having a set of discrete inner frame side members, a plurality of mounting studs projecting from the inner frame member in a second pattern aligned with a second complementary pattern of mounting bores in a rear surface of the insulation body assembly, each mounting bore having a respective mounting bore sidewall spaced from an aligned mounting stud received therein, and a curing connection medium in the plurality of mounting bores to define a plurality of mounting connections from the inner and outer frame assemblies to the insulating body assembly.

18 Claims, 12 Drawing Sheets

(56) References Cited

U.S. PATENT DOCUMENTS

| | | | | | |
|---|---|---|---|---|---|
| 4,338,753 | A * | 7/1982 | Janke | E06B 3/26307 | 52/204.593 |
| 4,612,743 | A * | 9/1986 | Salzer | E06B 3/28 | 49/501 |
| 4,920,718 | A * | 5/1990 | Artwick | E06B 3/549 | 52/204.591 |
| 4,989,381 | A * | 2/1991 | De Block | E06B 1/30 | 49/504 |
| 5,037,234 | A * | 8/1991 | De Jong | E06B 3/9616 | 403/268 |
| 5,497,588 | A * | 3/1996 | Martin | E06B 3/5892 | 52/208 |
| 5,894,706 | A * | 4/1999 | Herbst | E06B 3/22 | 160/369 |
| 8,572,929 | B2 | 11/2013 | Stumm | | |
| 9,644,367 | B2 * | 5/2017 | Kawano | E04B 1/48 | |
| 2005/0166507 | A1 * | 8/2005 | Hendricks | E06B 3/5892 | 52/506.06 |
| 2005/0183351 | A1 * | 8/2005 | Brunnhofer | E06B 3/26305 | 52/204.5 |

* cited by examiner

500

600

METAL FRAME AND GLASS PANE DOOR ELEMENT, WINDOW ELEMENT, SYSTEMS INCLUDING SAME, AND METHOD FOR MAKING SAME

CROSS REFERENCE TO RELATED APPLICATIONS

This application is not related to any other applications on the date of filing.

FIELD OF THE INVENTION

The disclosure relates generally to door systems, window systems, and methods for making door systems and window systems. The disclosure relates more particularly to door systems and window systems having an element including a metal frame assembly and insulated glass pane.

BACKGROUND OF THE INVENTION

Door systems and window systems (collectively "door systems") may include a fixed casement framing the portal, and a door body or element supported for swinging movement relative to the casement. Window systems may be of similar construction, with the window element typically being fixed in the casement. The casement, for example, may be formed primarily of metal or wood and may include weather-stripping. The door element or window element (collectively "element") may include a metal frame assembly and an insulated glass pane mounted in the frame. The element may include a set of elongated hollow frame profiles joined at corners to form the metal frame assembly. The metal frame assembly may include insulation elements between an outer metal frame assembly exposed to weather and an inner metal frame assembly insulated from the outer metal frame. The element may include an insulated glass pane in the metal frame assembly. The appearance of systems including these metal frame and glass pane elements may vary widely in relation to appearance of the hollow frame profiles and appearance of the metal frame assembly formed by joining a set of such profiles.

Such metal frame and glass pane elements may be constructed by cold-forming metals to form the frame profiles, and thus may be difficult and time-consuming to manufacture. Some may be formed of extruded lightweight metal profiles, such as extruded aluminum profiles, and these systems may include visible joints between the profiles that impair their appearance. Other metal frame and glass pane elements may be assembled by sandwich construction techniques. Elements having sandwich constructions may suffer delamination failures, requiring expensive repairs or replacement by building owners or the manufacturer. Determining and addressing root causes of delamination failures may require major investigation, engineering analysis, changes in product designs and manufacturing methods, and also may require long periods of testing. Undesired or unacceptable variations in product quality may be caused, over long periods of production. For reasons stated above and for other reasons which will become apparent to those skilled in the art upon reading and understanding the present specification, there is a need in the art for improved metal frame and glass pane door and window elements, systems including such elements, and methods for making the elements.

BRIEF DESCRIPTION OF THE INVENTION

The above-mentioned shortcomings, disadvantages and problems are addressed herein, as will be understood by those skilled in the art upon reading and studying the following specification. This Brief Description is a summary provided to introduce a selection of concepts in a simplified form that are further described below in more detail in the Detailed Description. This summary is not intended to identify key or essential features of the claimed subject matter.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

In one aspect, a door element, system including a door element, and method for making a door element, may include a door element having a metal frame system and window pane mounted in the metal frame system, which is of improved construction and may have improved appearance. The subject matter may provide high product quality and performance, and reduce or eliminate delamination failures and the disadvantages associated therewith. In one aspect, the subject matter may provide improvement in the method of manufacturing, such as simplification and shortening of manufacturing steps, improved component specifications and tolerances, improved consistency of product quality, and reduction of waste and cost due to manufacturing defects of components and assembly errors such as misalignment errors between components. The subject matter also may improve the method of manufacturing and product quality by reducing impact of environmental variations, such as temperature and humidity variations, in the manufacturing environment. The subject matter also may simplify manufacturing and installation, and reduce need for exercise of skill and diligence in the application of curable materials and monitoring of curing processes that are subject to high degrees of variation and problems, by employees engaged in manufacturing door elements.

Apparatus, systems, and methods of varying scope are described herein. These aspects are indicative of various non-limiting ways in which the disclosed subject matter may be utilized, all of which are intended to be within the scope of the disclosed subject matter. In addition to the aspects and advantages described in this summary, further aspects, features, and advantages will become apparent by reference to the associated drawings, detailed description, and claims.

BRIEF DESCRIPTION OF THE DRAWINGS

The disclosed subject matter itself, as well as further objectives, and advantages thereof, will best be illustrated by reference to the following detailed description of embodiments of the device read in conjunction with the accompanying drawings, wherein:

FIG. 7A is an enlarged partial cross-sectional view of window element 300, taken generally along 7B-7B in FIG. 3, showing a mounting stud connection between inner frame assembly and insulating body assembly.

DETAILED DESCRIPTION OF THE INVENTION

Figure 1:
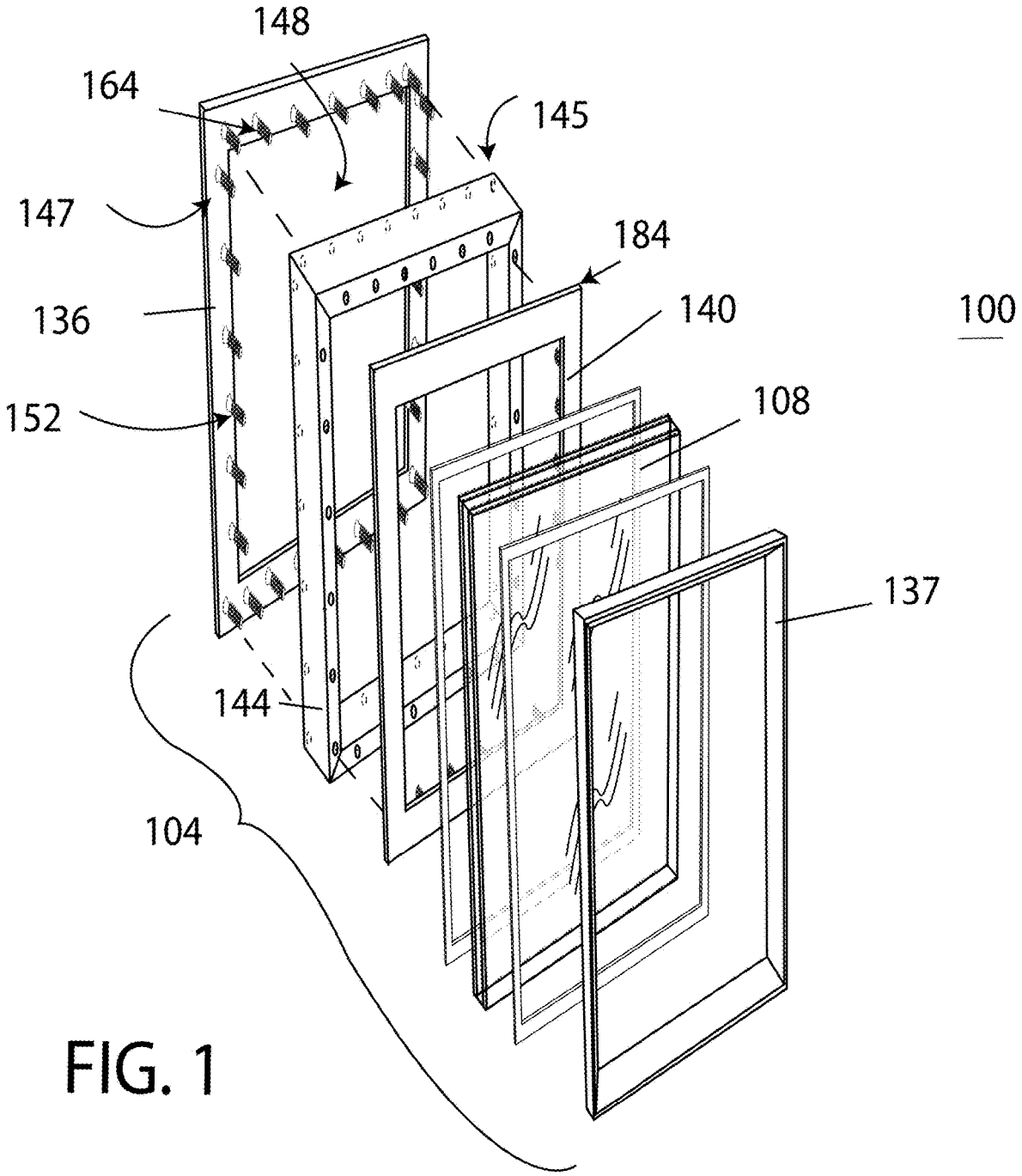
FIG. 1 is a simplified assembly view of door element 100 according to an embodiment.

In the following detailed description, reference is made to the accompanying drawings which form a part hereof, and in which is shown by way of illustration specific embodiments which may be practiced. These embodiments are described in sufficient detail to enable those skilled in the art to practice the embodiments and disclosure. It is to be understood that other embodiments may be utilized, and that logical, mechanical, electrical, and other changes may be made without departing from the scope of the embodiments and disclosure. In view of the foregoing, the following detailed description is not to be taken as limiting the scope of the embodiments or disclosure.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising" or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

It will be appreciated that for simplicity and clarity of illustration, where considered appropriate, reference numerals may be repeated among the figures to indicate corresponding or analogous elements. In addition, numerous specific details are set forth in order to provide a thorough understanding of the implementations described herein. However, it will be understood by those of ordinary skill in the art that the implementations described herein may be practiced without these specific details. In other instances, well-known methods, procedures and components have not been described in detail so as not to obscure the implementations described herein. Also, the description is not to be considered as limiting the scope of the implementations described herein.

The detailed description set forth herein in connection with the appended drawings is intended as a description of exemplary embodiments in which the presently disclosed apparatus and system can be practiced. The term "exemplary" used throughout this description means "serving as an example, instance, or illustration," and should not necessarily be construed as preferred or advantageous over other embodiments.

Figure 2:
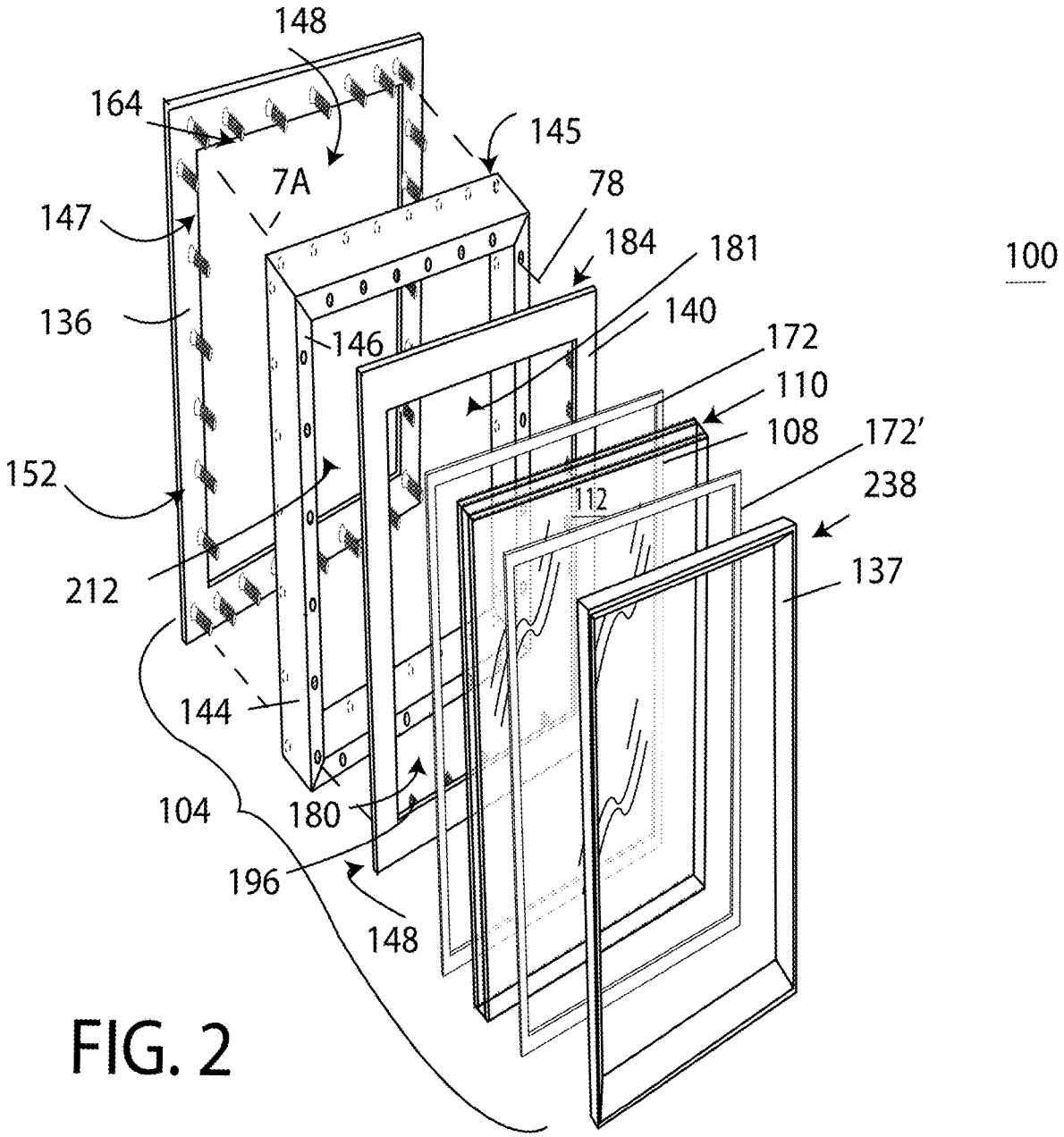
FIG. 2 is a simplified exploded view illustrating door element 100, shown generally in FIG. 1.
Figure 7B:
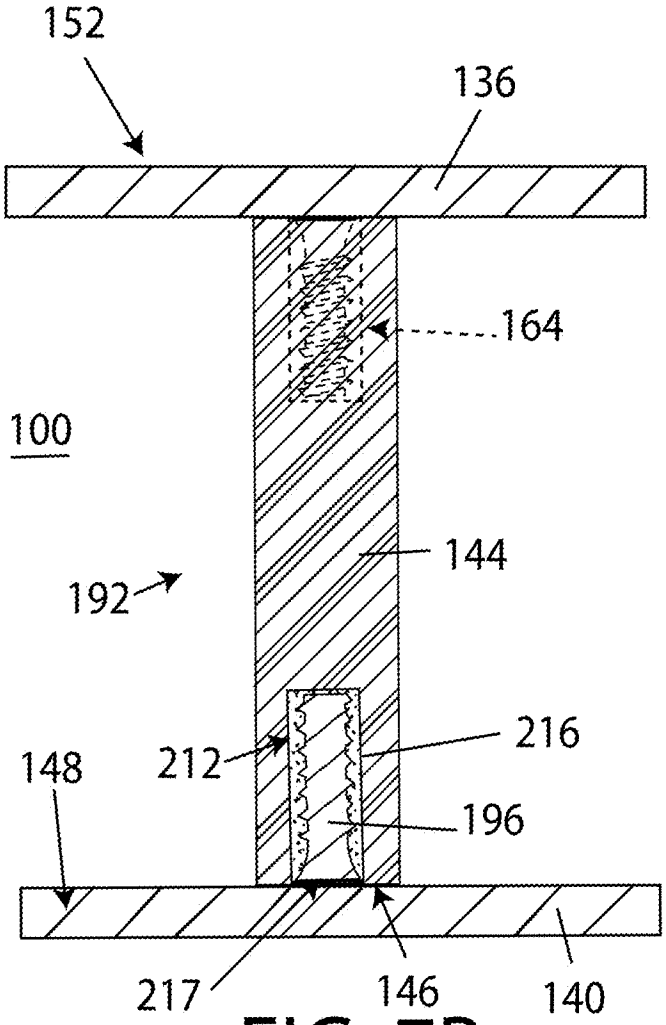
FIG. 7A is an enlarged partial cross-sectional view of window element 300, taken generally along 7A-7A in FIG. 3, showing a mounting stud connection between outer frame assembly and insulating body assembly.
Figure 7A:
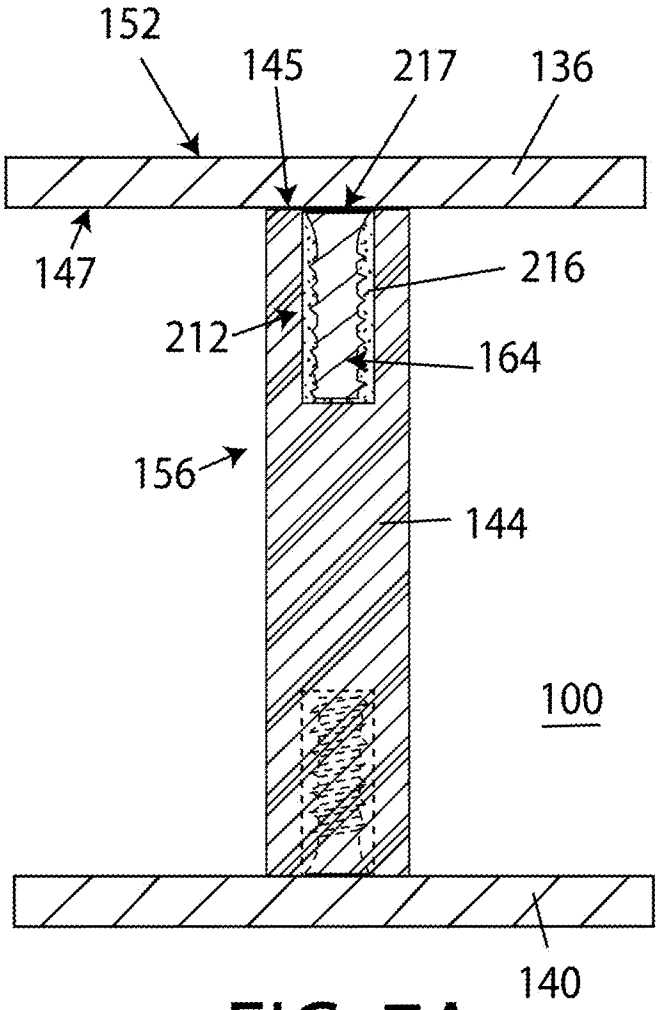

FIG. 1 is a simplified assembly view of door element 100 of a door system, according to an embodiment. As shown in FIG. 1, door element 100 may include metal frame assembly 104 configured to support insulating glass unit 108. Metal frame assembly 104 may include a plurality of metal frame structural layers arranged in a sandwich structural configuration. FIG. 2 is a simplified exploded view illustrating door element 100, shown generally in FIG. 1. As shown in FIG. 2, metal frame assembly 104 may include outer frame assembly 136, insulating body assembly 144, inner frame assembly 140, stop frame assembly 137 and divider grid 256. As shown in FIG. 2, the outer frame assembly 136 may include a continuous flat metal outer frame member 152 joined in abutting surface to surface relationship with an outer side 145 of insulation body assembly 144, by a plurality of outer frame mounting studs 164 spaced along the length of first surface 147 of flat metal outer frame member 152. As shown in FIG. 2, the outer frame assembly 136 may include an outer frame interior opening 148 defined by an inside edge of continuous flat metal outer frame member 152. Referring to FIG. 7A, the outer frame assembly 136 may include a plurality of outer frame mounting studs 164 aligned to be received in corresponding mounting bores 212 of abutting insulation body assembly 144 to form mounting stud connections 164 by being intimately joined in bonding relationship with curing connection medium 216 disposed in mounting bores 212. The curing connection medium 216, for example, may be a cured reaction product of epoxy resin, cured by mixing with a hardening agent which initiates curing reactions. The curing reaction product when hardened may fill the interstitial space in the mounting bores 212, between the mounting bore wall and outer surfaces of the corresponding outer frame mounting stud 164. The curing connection medium 216 formed of curing reaction product of epoxy resin may provide an integrated mounting connection relationship between the outer frame mounting studs 164 and mounting bores 212 of the insulation body assembly 144, and thus may join the outer frame assembly 136 in integral mounting connection relationship with the insulation body assembly 144. Mounting stud 164 may be joined to metal outer frame member 152 by a spot weld 217.

Referring to FIG. 2, metal frame assembly 104 may include flat metal inner frame member 184 joined in abutting surface to surface relationship with an inner side 146 of insulation body assembly 144 by a plurality of inner frame mounting studs 196. The plurality of inner frame mounting studs 196 may be spaced along the length of first surface 148 of flat metal inner frame member 184. Each of the inner frame mounting studs 196 may be have the configuration shown in FIG. 7B. Referring to FIG. 7B, the inner frame assembly 140 may include a plurality of inner frame mounting studs 196 aligned be received in corresponding mounting bores 212 located in inner side 146 of abutting insulation body assembly 144, to form mounting stud connections 164 by being intimately joined in bonding relationship with curing connection medium 216 disposed in mounting bores 212. The curing connection medium 216, for example, may be a cured reaction product of epoxy resin, cured by mixing with a hardening agent which initiates curing reactions. The curing reaction product when hardened may fill the interstitial space in the mounting bores 212, between the mounting bore wall and outer surfaces of the corresponding inner frame mounting stud 196. The curing connection medium 216 formed of curing reaction product of epoxy resin may provide an integrated mounting connection relationship between the inner frame mounting studs 196 and mounting bores 212 of the insulation body assembly 144, and thus may join the inner frame assembly 140 in integral mounting connection relationship with the insulation body assembly 144.

As shown in FIG. 2, the inner frame assembly 140 may include an inner frame interior opening 180 defined by an inside edge 181 of continuous flat metal inner frame member 184. It will be understood that inner frame interior opening 180 may be larger than outer frame interior opening 148. It will be understood that inner frame interior opening 180 may be large enough to enable insertion of insulating glass unit 108 during assembly of door element 100, with a margin for clearance that may be filled by structural silicone members 252 (shown in FIG. 6) and stop frame members 238 (shown in FIG. 2) to fix the insulating glass unit 108 in abutting relationship between outer frame members 152 having double sided adhesive mounting tape 172 against the first glass pane 110 thereof, and stop frame members 238 having double sided adhesive mounting tape 172' against the second glass pane 112, thus sandwiching the insulating glass unit 108 in fixed position. Door element 100 may have a simulated divided light configuration including a divider grid member 360 against insulating glass unit 108. As shown in FIG. 2, door element 100 may include a stop frame assembly 237 extending about the inner frame interior opening 180 and inside edge 181. Stop frame assembly 237 may include a plurality of adjoined stop frame members 238. Stop frame members 238, for example, may be formed of extruded metal, such as aluminum, and may have a truncated triangular cross-sectional shape. Stop frame member 238 may be joined to an abutting inner frame member 184 along the common lengths thereof. Door element 100 may include adhesive material, which may be double-sided adhesive mounting tape 172', intermediate insulating glass unit 108 and stop frame member 238 for joining same in fixed, supporting relationship.

Figure 3:
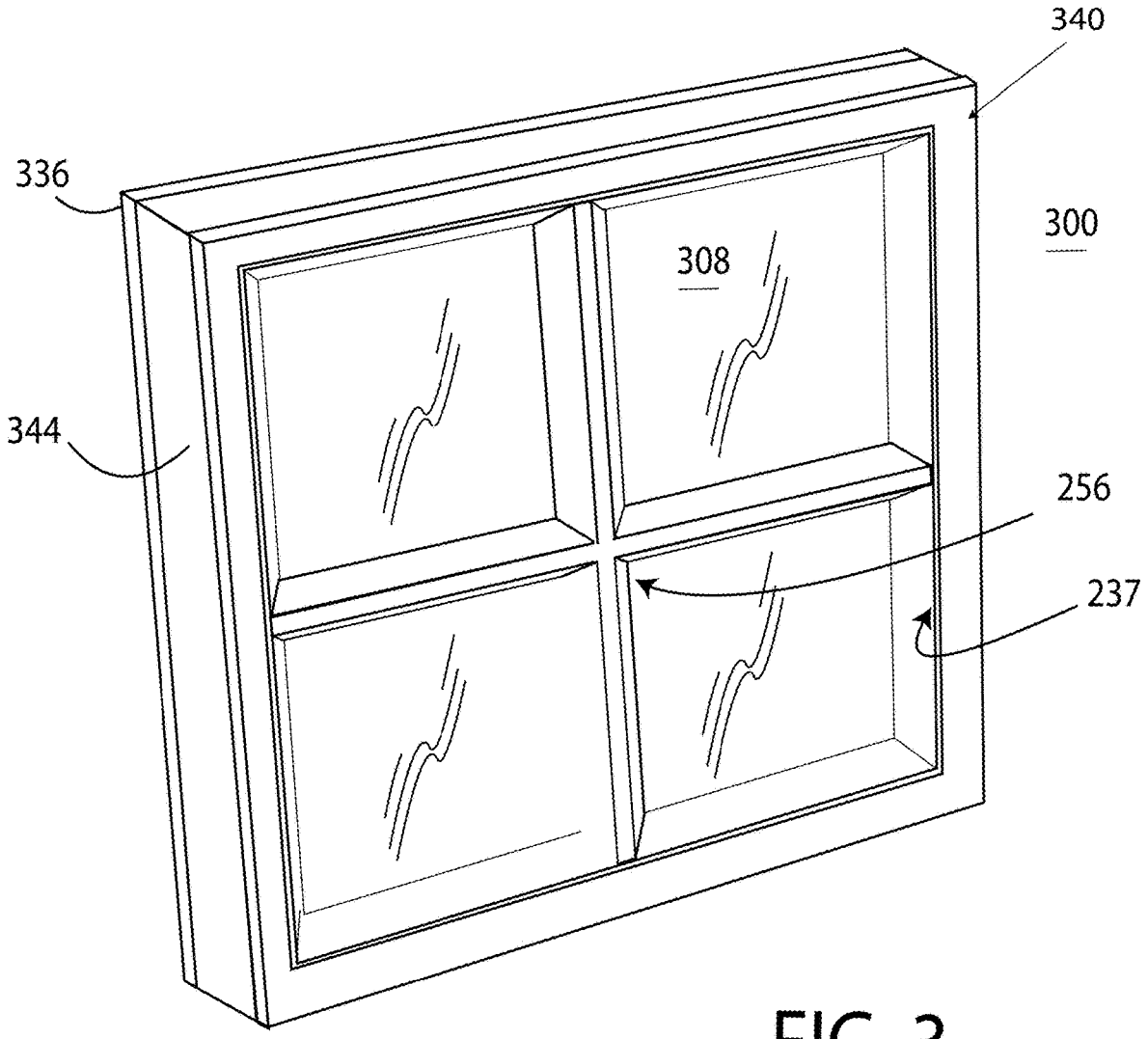
FIG. 3 is a simplified assembly view illustrating a window element 300 according to an embodiment.
Figure 4:
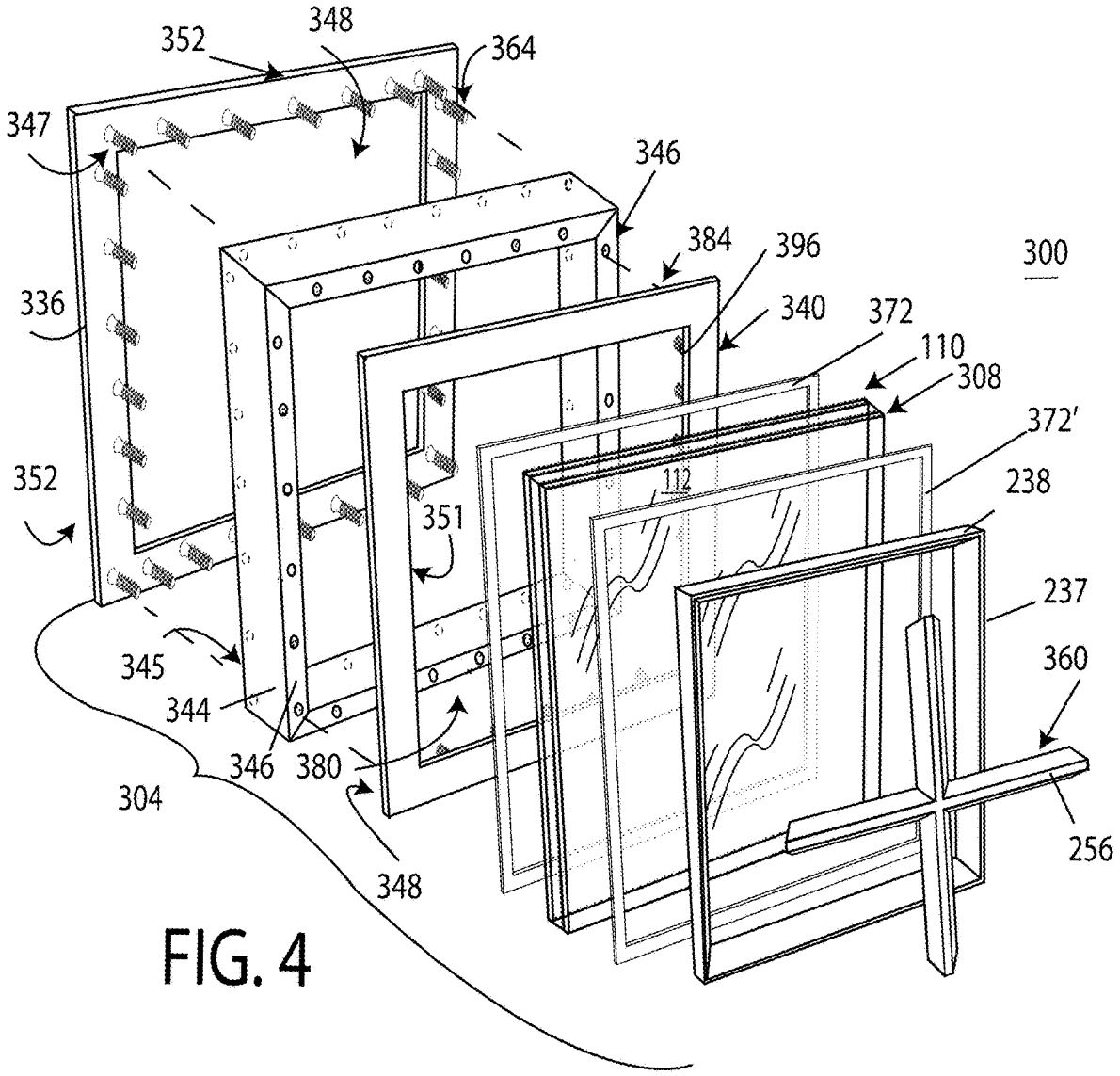
FIG. 4 is a simplified exploded view illustrating window element 300, shown generally in FIG. 3.

FIG. 3 is a simplified assembly view illustrating a window element 300 according to an embodiment. As shown in FIG. 3, window element 300 may include metal frame assembly 304 configured to support insulating glass unit 308. Metal frame assembly 304 may include a plurality of metal frame structural layers arranged in a sandwich structural configuration. FIG. 4 is a simplified exploded view illustrating window element 300, shown generally in FIG. 3. As shown in FIG. 4, metal frame assembly 304 may include outer frame assembly 336, insulating body assembly 344, inner frame assembly 340, stop frame assembly 237 and divider grid 256. Window element 300 may have a construction identical to door element 100, or may deviate from same if otherwise described in this part or shown in FIG. 3, 4, 6, 8 or 9. As shown in FIG. 4, the outer frame assembly 336 may include a continuous flat metal outer frame member 352 joined in abutting surface to surface relationship with an outer side 345 of insulation body assembly 344, by a plurality of outer frame mounting studs 364 spaced along the length of first surface 347 of flat metal outer frame member 352. As shown in FIG. 4, the outer frame assembly 336 may include an outer frame interior opening 348 defined by an inside edge 352 of continuous flat metal outer frame member 352. The outer frame mounting studs 364 may be identical to the mounting stud connections 164 of door element 100 (shown in FIG. 7).

Figure 6:
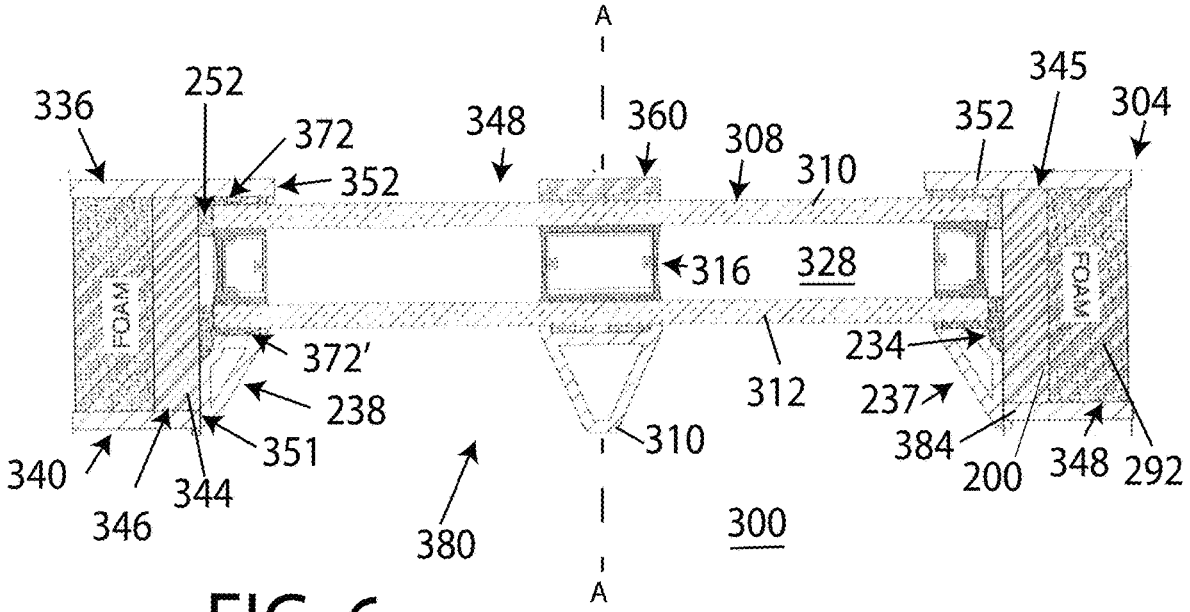
FIG. 6 is a cross-sectional view of window element 300, taken generally along 6-6 FIG. 3.

Referring to FIG. 4, metal frame assembly 304 may include flat metal inner frame member 384 joined in abutting surface to surface relationship with an inner side 346 of insulation body assembly 344 by a plurality of inner frame mounting studs 396. The plurality of inner frame mounting studs 396 may be spaced along the length of first surface 348 of flat metal inner frame member 384, and each may be identical to the inner frame mounting stud 196 of door element 100 (shown in FIG. 7A 7B). As shown in FIG. 4, the inner frame assembly 340 may include an inner frame interior opening 380 defined by an inside edge 351 of continuous flat metal inner frame member 384. It will be understood that inner frame interior opening 380 may be larger than outer frame interior opening 348. It will be understood that inner frame interior opening 380 may be large enough to enable insertion of insulating glass unit 308 during assembly of window element 300, with a margin for clearance that may be filled by structural silicone members 252 (shown in FIG. 6) and stop frame members 238 (FIG. 4) to fix the insulating glass unit 308 in abutting relationship between outer frame members 352 having double sided adhesive mounting tape 372 against the first glass pane 110 thereof, and stop frame members 238 having double sided adhesive mounting tape 372' against the second glass pane 112, thus sandwiching the insulating glass unit 308 in fixed position. Window element 300 may have a simulated divided light configuration including a divider grid member 360 against insulating glass unit 308. As shown in FIG. 6, window element 300 may include a stop frame assembly 237 extending about an inner frame interior opening 180. Stop frame assembly 237 may include a plurality of adjoined stop frame members 238. Stop frame member 238, for example, may be formed of extruded metal, such as aluminum, and may have a truncated triangular cross-sectional shape. Stop frame member 238 may be joined to an abutting inner frame member 384 along the common lengths thereof. Window element 300 may include adhesive material, which may be double-sided adhesive mounting tape 372', intermediate insulating glass unit 308 and stop frame member 238 for joining same in fixed, supporting relationship.

Figure 5:
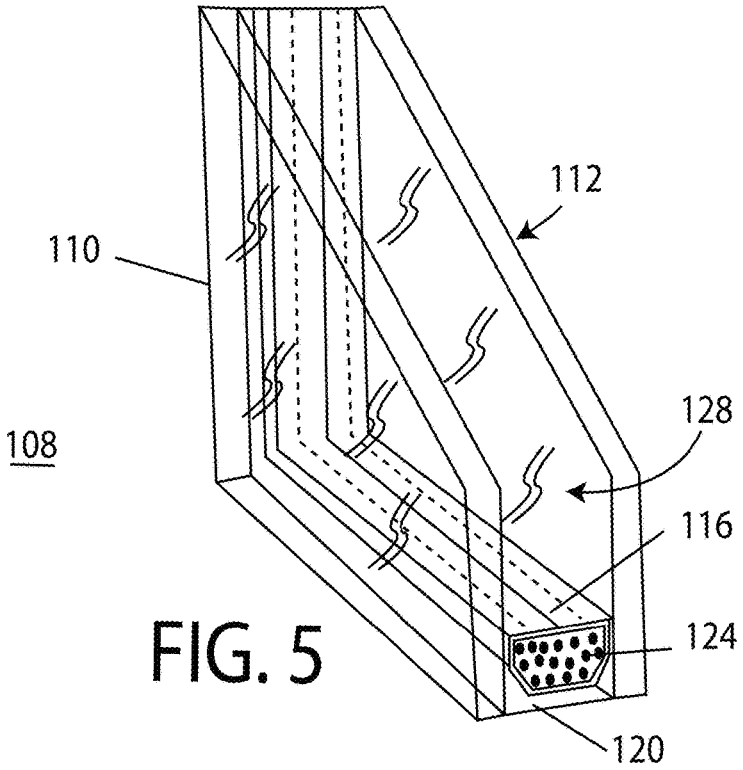
FIG. 5 is an enlarged simplified partial cross-sectional view of insulating glass unit 108, shown generally in FIG. 1.

FIG. 5 is an enlarged simplified partial cross-sectional view of insulating glass unit 108 (or IG unit), shown generally in FIG. 1. Insulating glass unit 108 may include a first glass pane 110 and second glass pane 112. Insulating glass unit 108 may include a spacer 116 disposed between first glass pane 110 and second glass pane 112. Insulating glass unit 108 may include a continuous seal 120 adjacent spacer 116 and disposed between first glass pane 110 and second glass pane 112. Continuous seal 120 may be configured for cooperation with first glass pane 110 and second glass pane 112 to provide a sealed air space 128. Air space 128 may be at low pressure, or may include a gas other than air, to provide a thermal gap between first glass pane 110 and second glass pane 112. Insulating glass unit 108 may include a dessicant 124 to reduce humidity.

FIG. 6 is a cross-sectional view of window element 300, taken generally along 6-6 FIG. 3. Window element 300 may include metal frame assembly 304 supporting the insulating glass unit 308 (or IG unit). Insulating glass unit 308 may be identical to insulating glass unit 108 depicted in FIG. 5 and described elsewhere herein. Insulating glass unit 308 may include a first glass pane 310 and second glass pane 312. Insulating glass unit 308 may include a spacer 316 disposed between first glass pane 310 and second glass pane 312. Insulating glass unit 308 may include a sealed air space 328 intermediate the first glass pane 310 and second glass pane 312.

As shown in FIG. 6, metal frame assembly 304 may include outer frame assembly 336, insulating body assembly 344 and inner frame assembly 340. Window element 300 may have a construction identical to door element 100, or may deviate from same if otherwise described in this part or shown in FIG. 3, 4, 6, 8 or 9. As shown in FIG. 6, the outer frame assembly 336 may include a continuous flat metal outer frame member 352 joined in abutting surface to surface relationship with an outer side 345 of insulation body assembly 344, by a plurality of outer frame mounting studs (see FIG. 7A; not shown in FIG. 6) spaced along the length of first surface 347 of flat metal outer frame member 352. The outer frame mounting studs (364 shown in FIG. 4) may be identical to the mounting stud connections 164 of door element 100 (shown in FIGS. 2 and 7A).

As shown in FIG. 6, the outer frame assembly 336 may include an outer frame interior opening 348 defined by an inside edge 351 of continuous flat metal outer frame member 352. Outer frame inside edge 352 is located nearer a central axis (A-A) of element 300 than the inner frame inside edge 351. Metal frame assembly 304 may include flat metal inner frame member 384 joined in abutting surface to surface relationship with an inner side 346 of insulation body assembly 344 by a plurality of inner frame mounting studs (396 shown in FIG. 4). As shown in FIG. 4, the plurality of inner frame mounting studs 396 may be spaced along the length of first surface 348 of flat metal inner frame member 384, and each may be identical to the mounting stud 196 of door element 100 (shown in FIGS. 2, 7A and 7B). As shown in FIG. 6, the inner frame assembly 340 may include an inner frame interior opening 380 defined by an inside edge 351 of continuous flat metal inner frame member 384. It will be understood that inner frame interior opening 380 may be larger than outer frame interior opening 348. It will be understood that inner frame interior opening 380 may be large enough to enable insertion of insulating glass unit 308 during assembly of window element 300, with a margin for clearance that may be filled by structural silicone members 252 and stop frame members 238 to fix the insulating glass unit 308 in abutting relationship between outer frame member 352 having double sided adhesive mounting tape 372 against the first glass pane 110, and stop frame members 238 having double sided adhesive mounting tape 372' at second glass pane 112, thus sandwiching the insulating glass unit 308 in fixed position. Referring to FIG. 6, window element 300 may have a simulated divided light configuration including a divider grid member 360 against either the first pane 110 or second pane 112 of insulating glass unit 308 and triangular muntin 310 on an opposite side of the insulating glass unit 308. As shown in FIG. 6, window element 300 may include a stop frame assembly 237 extending about an inner frame interior opening 380. Stop frame assembly 237 may include a plurality of adjoined stop frame members 238, which may have a truncated triangular cross-sectional shape, as shown in FIG. 6. Stop frame member 238, for example, may be formed of extruded metal, such as aluminum. Each stop frame member 238 may be joined to an abutting inner frame member 384 along the lengths thereof. Window element 300 may include a silicone sealant layer 234 intermediate the stop frame member 238 and abutting insulating body member 200. Window element 300 may include adhesive mounting material, such as double-sided adhesive mounting tape 372, 372' intermediate insulating glass unit 308 and stop frame member 238, and joined to same. Window element 300 may include a pair of structural silicone members 252 between insulating glass unit 308 and insulation body members 200 of the insulation body assembly 344. Window element 300 may include insulating foam 292 abutting the insulation body assembly 344.

FIG. 7A is an enlarged partial cross-sectional view of window element 100, taken generally along 7A-7A in FIG. 2, showing an outer frame mounting connection 156 between outer frame assembly 136 and insulating body assembly 144.

FIG. 7B is an enlarged partial cross-sectional view of window element 100, taken generally along 7B-7B in FIG. 2, showing an inner frame mounting connection 192 between inner frame assembly 140 and insulating body assembly 144.

Figure 8:
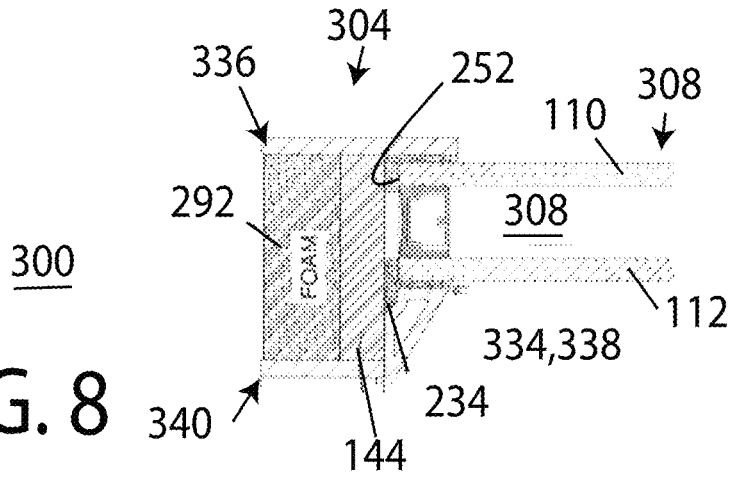
FIG. 8 is a partial cross-sectional view of window element 300 shown in FIG. 6, illustrating a portion of the metal frame assembly supporting the insulating glass unit.

FIG. 8 is a partial cross-sectional view of window element 300 generally shown in FIG. 6, illustrating a portion of the metal frame assembly 304 supporting the insulating glass unit 308. Window element 300 may be identical to door element 100, or may deviate from same if otherwise described in this part or shown in FIG. 8. Flat metal outer frame member 152 is joined in abutting surface to surface relationship with an outer side 345 of insulation body assembly 344 by a plurality of outer frame mounting studs (not shown in FIG. 8) spaced along the length of first surface 347 flat metal outer frame member 152 and each identical to the mounting stud connection 204 of door element 100 and illustrated in FIG. 7. Metal frame assembly 304 may include flat metal inner frame member 184 joined in abutting surface to surface relationship with an inner side 346 of insulation body assembly 344 by a plurality of inner frame mounting studs (not shown in FIG. 8) spaced along the length of first surface 348 of flat metal inner frame member 184, and each being identical to the mounting stud 196 of door element 100 and illustrated in FIG. 7.

Figure 9:
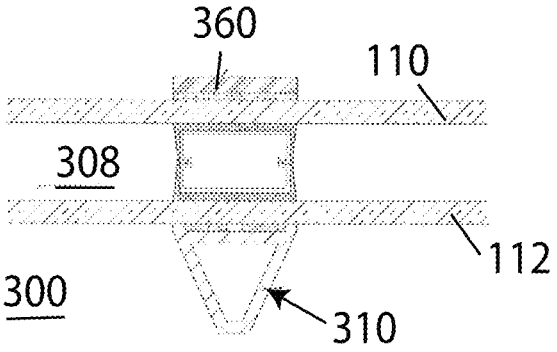
FIG. 9 is a partial cross-sectional view of window element 300 shown in FIG. 6, illustrating a divider grid member, insulating glass unit and triangular muntin in a simulated divided light configuration.

FIG. 9 is a partial cross-sectional view of window element 300 generally shown in FIG. 6, illustrating a divider grid member 360, insulating glass unit 308 and triangular muntin 310 in a simulated divided light configuration.

Figure 10:
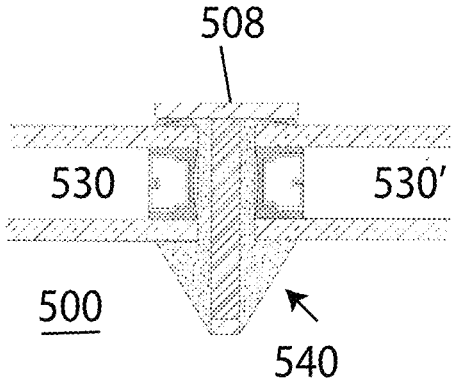
FIG. 10 is a partial cross-sectional view of a window element 400 having a truly divided light configuration, including a divider grid member, two insulating glass units, and a putty seal supporting the two insulating glass units.

FIG. 10 is a partial cross-sectional view of a window element 500 having a truly divided light configuration, in an embodiment. Window element 500 may include a divider grid member 508, first and second insulating glass units 530, 530', and a putty seal 540 supporting the two insulating glass units 530, 530'.

Figure 11:
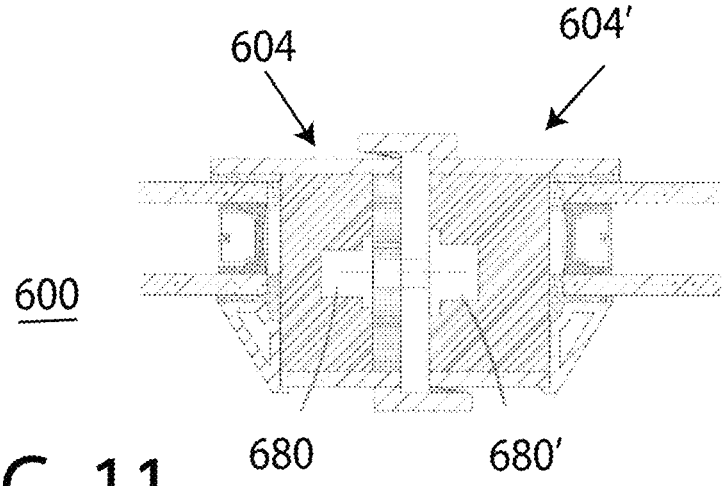
FIG. 11 is a partial cross-sectional view showing door lock assemblies of door element 100 and door element 100', in an alternative embodiment.

FIG. 11 is a partial cross-sectional view showing first and second door latch assemblies 680, 680' of respective first and second door elements 604, 604' in a French door system 600 in an alternative embodiment.

Figure 12:
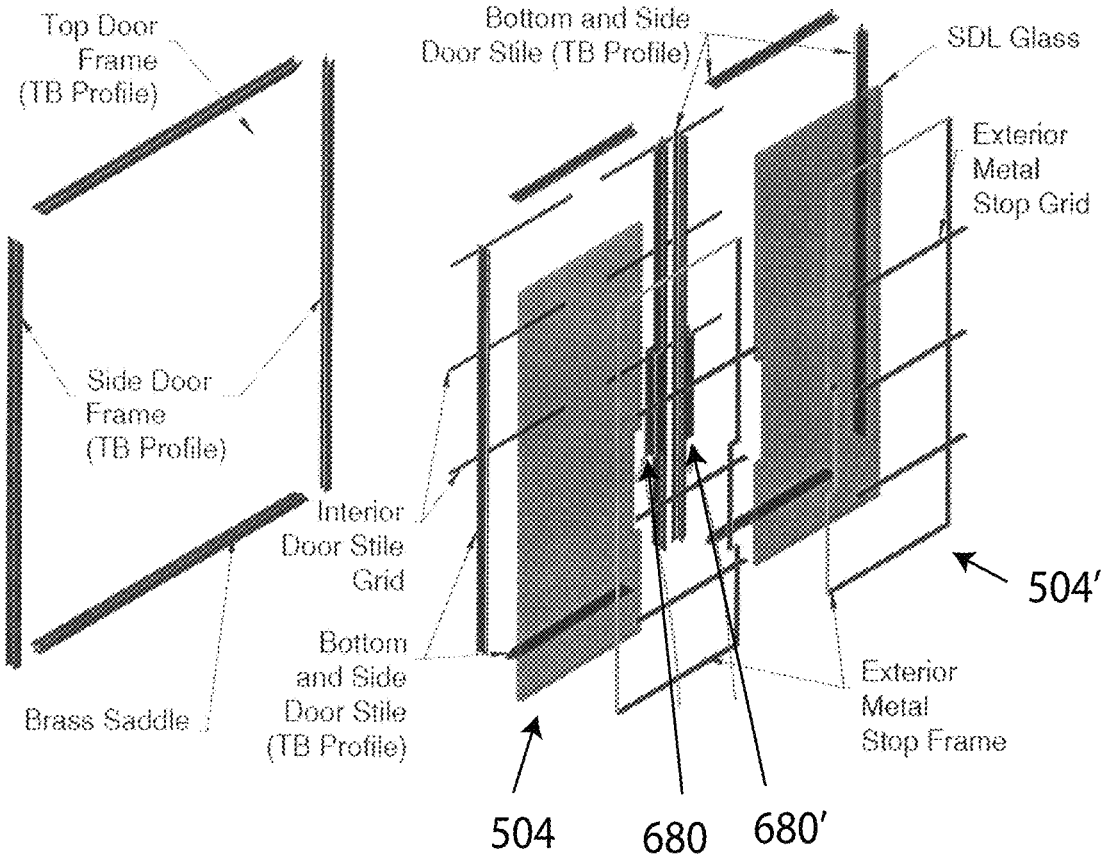
FIG. 12 is a simplified exploded view illustrating a French door system 500 including dual door elements 504, 504'.

FIG. 12 is a simplified exploded view illustrating a French door system 500 including dual door elements 504, 504'. Door elements 504, 504' may be identical to door element 100, described elsewhere herein and shown in FIG. 1.

Figure 13:
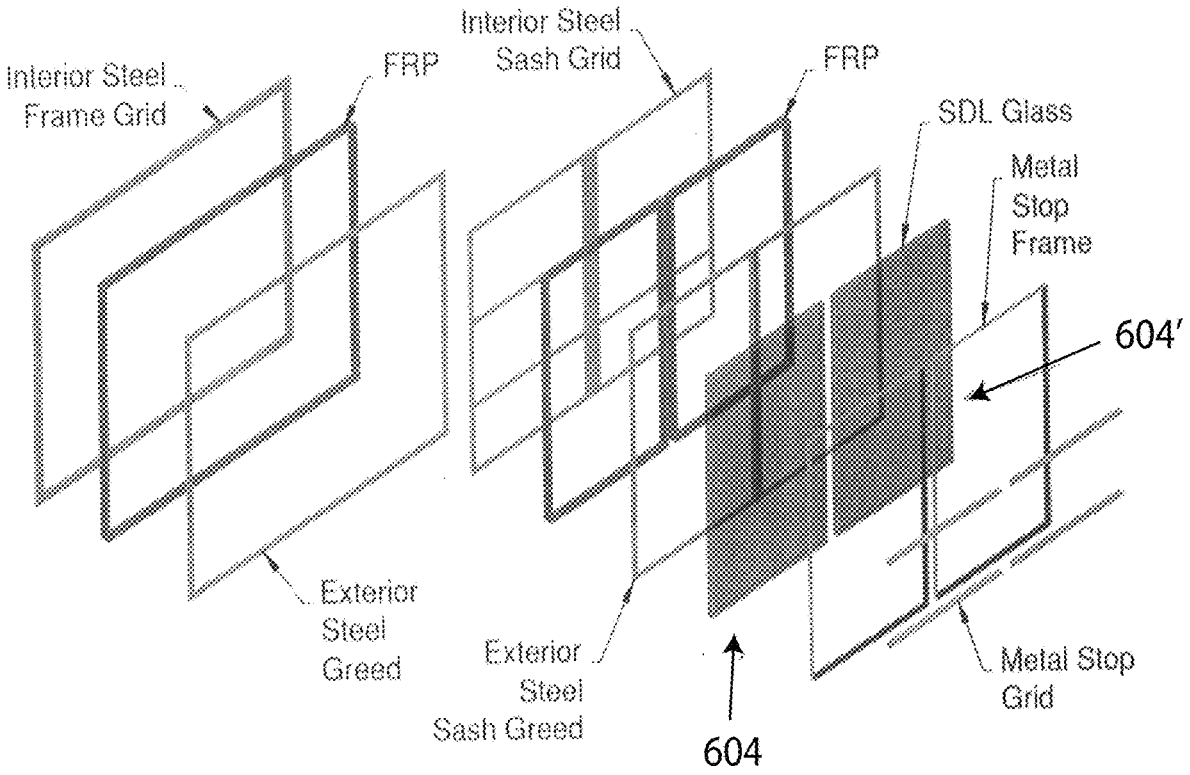
FIG. 13 is a simplified exploded view illustrating a French casement window system 600 including dual window elements 604, 604'.

FIG. 13 is a simplified exploded view illustrating a French casement window system 600 including dual window elements 604, 604'. Window elements 604, 604' may be identical to window element 300, described elsewhere herein and shown in FIG. 3.

Figure 14:
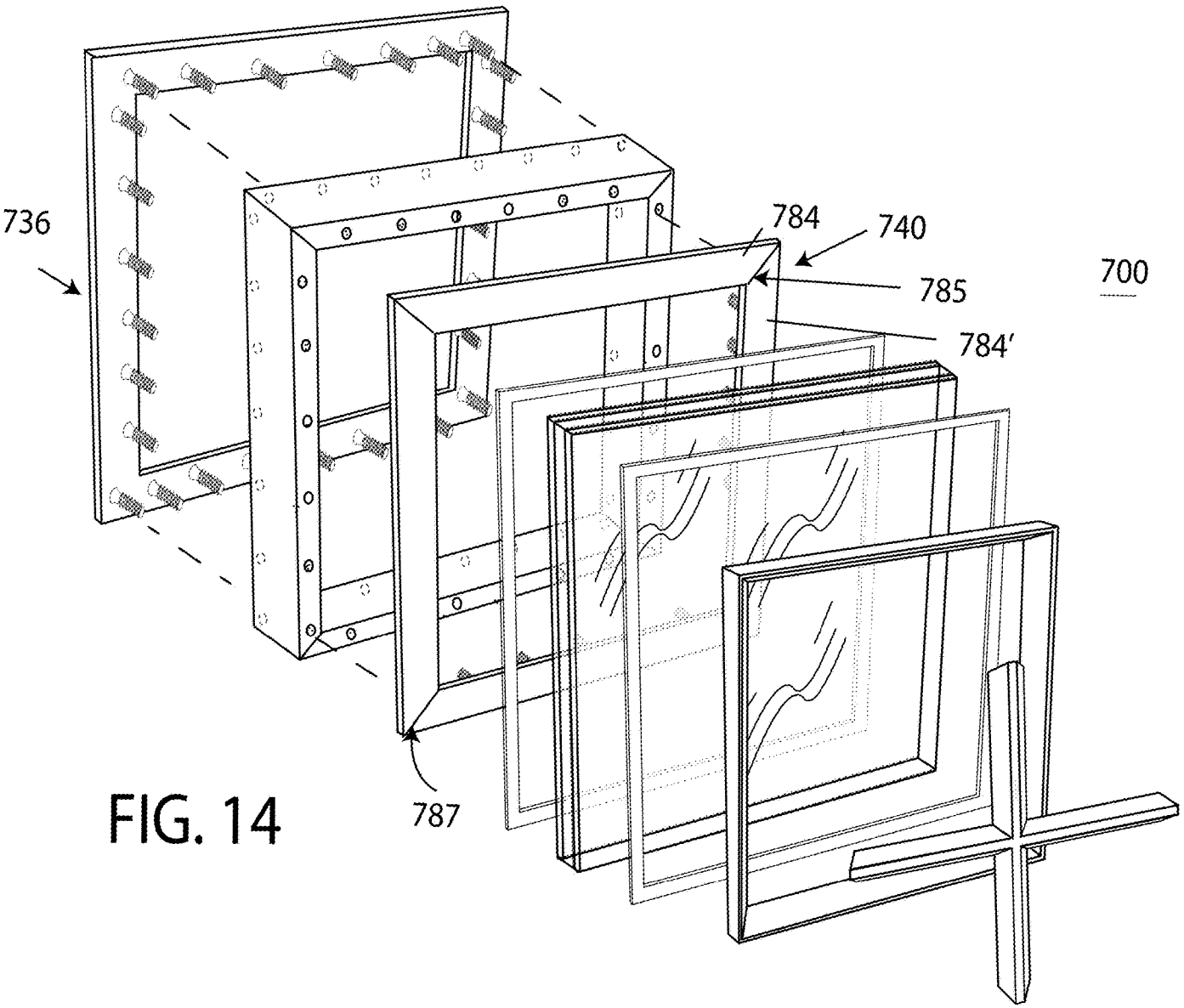
FIG. 14 is a simplified exploded view illustrating door element 700 in an embodiment.

FIG. 14 is a simplified exploded view of door element 700 in an embodiment. Door element 700 may be identical to door element 100 shown in FIG. 2 and described elsewhere herein, except for differences described in this paragraph or shown in FIG. 14. Referring to FIG. 14, door element 700 includes a unitary outer frame assembly 736 formed by being cut from a single sheet of material, such as steel, and is similar to door element 100 (shown in FIG. 2) in this respect. Referring to FIG. 14, door element 700 includes a multi-part inner frame assembly 740. Multi-part inner frame assembly 740 is formed by an assembled, adjoined set of four elongated inner frame members 784 in adjoined, intersecting relationship at a set of inner frame corner joints 785 between same. Door element 700 thus is dissimilar from door element 100 (shown in FIG. 2) in having the multi-part inner frame assembly 740 formed of plural elongated inner frame members 784, with the inner frame corner joints 785 formed therebetween, whereas in contrast door element 100 (see FIG. 2) has a unitary inner frame assembly 140 cut from a single sheet of material without joints at corners thereof. Shown in FIG. 14 is the multi-part inner frame assembly 740 formed of plural elongated inner frame members 784, to be joined at inner frame corner joints 785 formed between each pair of intersecting inner frame members 784. In the particular arrangement shown in FIG. 14, each of the inner frame members 784 at the opposite ends thereof forms corner joint 785 having a forty-five (45) degree angle complementary to the adjoining inner frame member 784'. Referring to FIG. 14, each of the inner frame corner joints 785 may have a joint seam 787 defined between adjoined inner frame members 784. In the particular embodiment shown in FIG. 14, joint seam 787 may be spot welded and thus may include weld seams. In other embodiments (not shown), the joint seams may be open without filler material; closed or filled by filler material such as a bead of joint caulk or silicone filler; or filled or completed by connecting structure. In other embodiments (not shown), the inner frame corner joints may be formed differently, such as by including a discrete ninety-degree corner member (not shown) joined between adjacent inner frame members.

Figure 15:
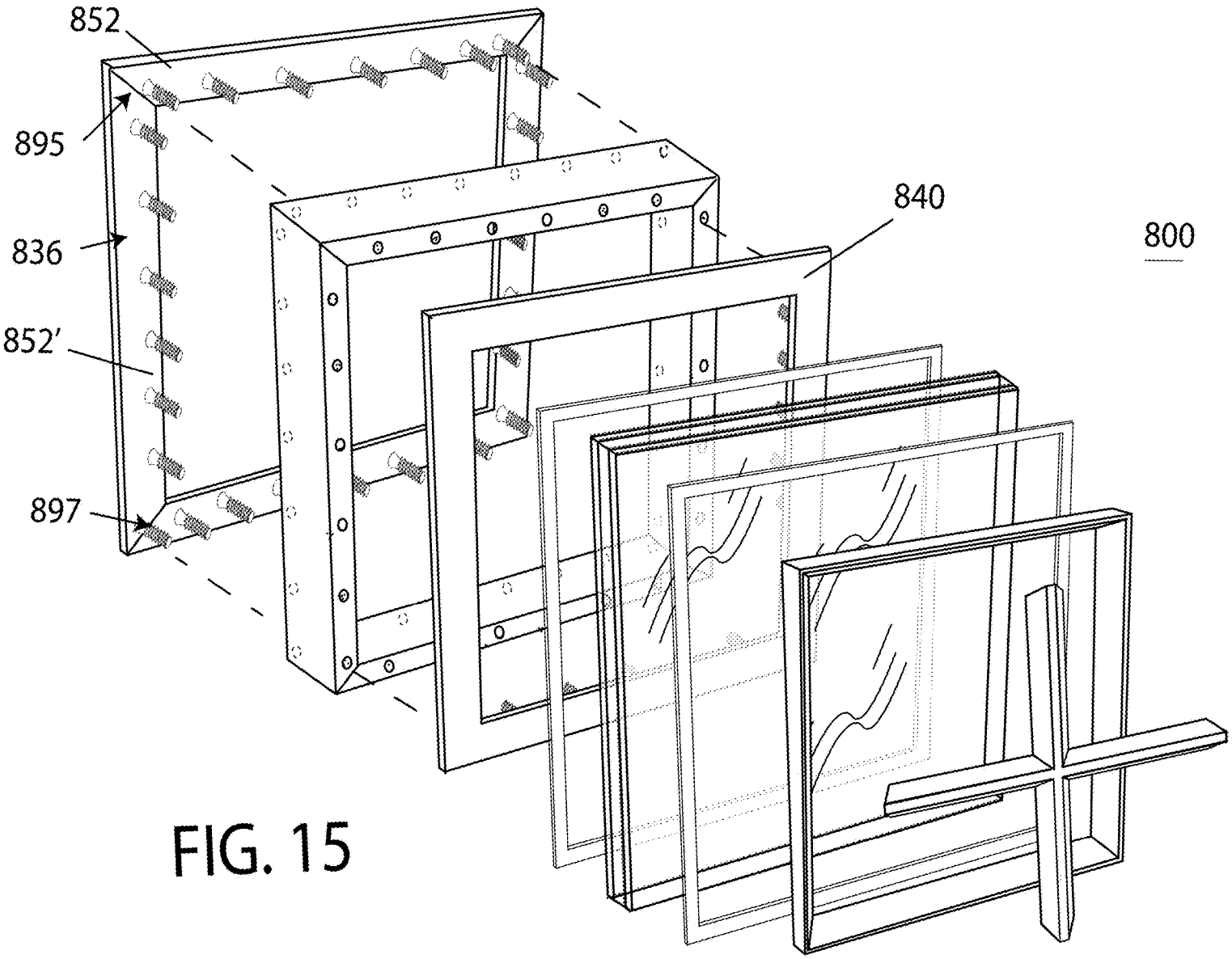
FIG. 15 is a simplified exploded view illustrating door element 800 in an embodiment.

FIG. 15 is a simplified exploded view illustrating door element 800 in an embodiment. Door element 800 may be identical to door element 100 shown in FIG. 2 and described elsewhere herein, except for differences described in this paragraph or shown in FIG. 15. Referring to FIG. 15, door element 800 includes a unitary inner frame assembly 840 formed by being cut from a single sheet of material, such as steel, and is similar to door element 100 (shown in FIG. 2) in this respect. Door element 800 may include a multi-part outer frame assembly 836. Multi-part outer frame assembly 836 is formed by an assembled, adjoined set of four elongated outer frame members 852 in adjoined, intersecting relationship at a set of outer frame corner joints 895 between same. Door element 800 thus is dissimilar from door element 100 (shown in FIG. 2) in having the multi-part outer frame assembly 836 formed of plural elongated outer frame members 852, with the outer frame corner joints 895 formed therebetween, whereas in contrast door element 100 (see FIG. 2) has a unitary outer frame assembly 136 cut from a single sheet of material without joints at corners thereof. The multi-part outer frame assembly 836 may be formed of plural elongated outer frame members 852, to be joined at outer frame corner joints 895 formed between each pair of intersecting outer frame members 852. In the particular arrangement shown in FIG. 15, each of the outer frame members 852 at the opposite ends thereof has a forty-five (45) degree angle complementary to the adjoining outer frame member 852'. Referring to FIG. 15, each of the outer frame corner joints 895 may have a joint seam 897 defined between adjoined outer frame members 852, 852'. In the particular embodiment shown in FIG. 15, joint seam 897 may be spot welded and thus may include weld seams. In other embodiments (not shown), the joint seams may be open without filler material; closed or filled by filler material such as a bead of joint caulk or silicone filler; or filled or completed by connecting structure. In other embodiments (not shown), the inner frame corner joints may be formed differently, such as by including a discrete ninety-degree corner member joined between adjacent inner frame members.

Apparatus, methods and systems according to embodiments of the disclosure are described. Although specific embodiments are illustrated and described herein, it will be appreciated by those of ordinary skill in the art that any arrangement which is calculated to achieve the same purposes can be substituted for the specific embodiments shown. This application is intended to cover any adaptations or variations of the embodiments and disclosure. For example, although described in terminology and terms common to the field of art, exemplary embodiments, systems, methods and apparatus described herein, one of ordinary skill in the art will appreciate that implementations can be made for other fields of art, systems, apparatus or methods that provide the required functions. The invention should therefore not be limited by the above described embodiment, method, and examples, but by all embodiments and methods within the scope and spirit of the invention.

In particular, one of ordinary skill in the art will readily appreciate that the names of the methods and apparatus are not intended to limit embodiments or the disclosure. Furthermore, additional methods, steps, and apparatus can be added to the components, functions can be rearranged among the components, and new components to correspond to future enhancements and physical devices used in embodiments can be introduced without departing from the scope of embodiments and the disclosure. One of skill in the art will readily recognize that embodiments are applicable to future systems, future apparatus, future methods, and different materials.

All methods described herein can be performed in a suitable order unless otherwise indicated herein or otherwise clearly contradicted by context. The use of any and all examples, or exemplary language (e.g., "such as"), is intended merely to better illustrate the disclosure and does not pose a limitation on the scope of the disclosure unless otherwise claimed. No language in the specification should be construed as indicating any non-claimed element as essential to the practice of the disclosure as used herein.

Terminology used in the present disclosure is intended to include all environments and alternate technologies that provide the same functionality described herein.

What is claimed is:

1. An element including an insulating glass unit mounted in a metal frame assembly, said element comprising:

an outer frame assembly comprising a unitary outer frame member, said unitary outer frame member comprising a complementary set of adjoining elongated outer frame side members in integral relationship, said set of adjoining side members formed in common of a metal sheet, said outer frame member comprising a continuous outer frame innermost surface disposed in spaced parallel opposition to a continuous outer frame outermost surface defined by said metal sheet, said outer frame assembly comprising a plurality of outer frame mounting studs projecting from said outer frame member in perpendicular relationship to said outer frame innermost surface in a first pattern aligned with a first complimentary pattern of a plurality of front surface mounting bores of an insulation body assembly, said plurality of outer frame mounting studs aligned to be received in said plurality of front surface mounting bores when said outer frame member is disposed in common alignment with said insulation body assembly with said outer frame innermost surface in parallel abutting back to front surface to surface relationship with a continuous front surface of said insulation body;

said insulation body assembly having said continuous front surface disposed in spaced parallel opposition to a continuous rear surface defined by cooperation of a complementary set of intersecting adjoined elongated insulating body side members, said insulation body assembly comprising said first complementary pattern of said plurality of front surface mounting bores defined in said front surface thereof, each of said front surface mounting bores having a respective mounting bore sidewall spaced from said aligned outer frame mounting stud received therein;

a curing connection medium in said plurality of front surface mounting bores, said curing connection medium defining an outer frame mounting connection from said outer frame assembly to said insulating body assembly, said outer frame mounting connection comprising said curing connection medium joined in bonding relationship with said mounting bore sidewall, said outer frame mounting connection comprising said curing connection medium joined in bonding relationship with said outer frame mounting stud.

2. The element of claim 1, said element further comprising:

said insulation body assembly comprising a second complementary pattern of a plurality of rear surface mounting bores defined in said rear surface thereof, each of said rear surface mounting bores having a respective mounting bore sidewall.

3. The element of claim 2, said element further comprising:

said first complementary pattern disposed in unaligned offset relationship to said second complementary pattern to reduce forces in said insulation body assembly from outer frame mounting connections with said plurality of outer frame mounting studs and from inner frame mounting connections with a plurality of inner frame mounting studs.

4. The element of claim 1, said element further comprising:

an inner frame assembly comprising a complementary set of plural discrete inner frame side members, said set of plural discrete inner frame side members joined at respective of a set of inner frame corner joints defined between adjoining ends of intersecting adjacent pairs thereof, said set of plural discrete inner frame side members each comprising a separate member formed of metal sheet, said inner frame assembly comprising a continuous inner frame innermost surface disposed in spaced parallel opposition to a continuous inner frame outermost surface defined by cooperation of said set of plural discrete inner frame side members joined at said set of inner frame corner joints, said inner frame assembly comprising a plurality of inner frame mounting studs projecting from said inner frame assembly in perpendicular relationship to said inner frame outermost surface in a second pattern aligned with a second complimentary pattern of a plurality of rear surface mounting bores of said insulation body assembly, said plurality of inner frame mounting studs aligned to be received in said plurality of rear surface mounting bores when said inner frame member is disposed in common alignment with said insulation body assembly with said inner frame outermost surface in parallel abutting back to front surface to surface relationship with a continuous rear surface of said insulation body assembly;

said insulation body assembly having said continuous rear surface disposed in spaced parallel opposition to said continuous front surface, said second complimentary pattern of said plurality of rear surface mounting bores defined in said rear surface, each of said rear surface mounting bores having a respective mounting bore sidewall spaced from said aligned inner frame mounting stud received therein;

a curing connection medium in said plurality of rear surface mounting bores, said curing connection medium defining an inner frame mounting connection from said inner frame assembly to said insulating body assembly, said inner frame mounting connection comprising said curing connection medium joined in bonding relationship with said mounting bore sidewall, said inner frame mounting connection comprising said curing connection medium joined in bonding relationship with said inner frame mounting stud.

5. The element of claim 4, said element further comprising:

said inner frame assembly defining an inner frame interior opening disposed in spaced opposed relationship to an inner frame exterior perimeter;

a stop frame assembly extending about said inner frame interior opening, said stop frame assembly stopping said insulating glass unit from moving away from a fixed position in said metal frame assembly.

6. The element of claim 5, said element further comprising:

said stop frame assembly comprising a plurality of adjoined stop frame members anchored in fixed position by said inner frame assembly.

7. The element of claim 5, said element further comprising:

said plurality of adjoined stop frame members each having a truncated triangular cross-sectional shape.

8. The element of claim 4, said element further comprising:

said inner frame assembly defining an inner frame interior opening disposed in spaced opposed relationship to an inner frame exterior perimeter;

said outer frame assembly defining an outer frame interior opening disposed in spaced opposed relationship to an outer frame exterior perimeter;

said inner frame interior opening larger than outer frame interior opening to enable mounting of said insulating glass unit in said metal frame assembly by insertion of said insulating glass unit through said inner frame interior opening.

9. The element of claim 1, said element further comprising:

an outer layer of double-sided adhesive mounting tape affixing said outer frame assembly to said insulating glass unit;

an inner layer of double-sided adhesive mounting tape affixing said inner frame assembly to said insulating glass unit.

10. An element including an insulating glass unit mounted in a metal frame assembly, said element comprising:

an outer frame assembly comprising a unitary outer frame member, said outer frame assembly comprising a spaced plurality of mounting studs projecting from said outer frame member in perpendicular relationship to same in a first pattern aligned with a first complementary pattern of a plurality of spaced mounting bores defined in a front surface of an insulation body assembly, said plurality of mounting studs in said first pattern aligned to be received in said plurality of mounting bores in said first complementary pattern when said outer frame member is disposed in common alignment with said insulation body assembly in parallel abutting back to front surface to surface relationship with same;

an inner frame assembly comprising a multi-part inner frame member comprising a set of discrete inner frame side members, said inner frame assembly comprising a spaced plurality of mounting studs projecting from said inner frame member in perpendicular relationship to same in a second pattern aligned with a second complementary pattern of a plurality of spaced mounting bores defined in a rear surface of said insulation body assembly, said plurality of mounting studs in said second pattern aligned to be received in said plurality of mounting bores in said second complementary pattern when said inner frame member is disposed in common alignment with said insulation body assembly in parallel abutting back to front surface to surface relationship with same; and said insulation body assembly defined by cooperation of a complementary set of intersecting adjoined elongated insulating body side members, said insulation body assembly having said front surface disposed in spaced parallel opposition to a rear surface thereof, said insulation body assembly comprising said first complementary pattern of said plurality of mounting bores defined in said front surface thereof, said insulation body assembly comprising said second complementary pattern of said second plurality of mounting bores defined in said rear surface, each of said mounting bores having a respective mounting bore sidewall spaced from an aligned one of said plurality of mounting studs received therein; and a curing connection medium in said plurality of mounting bores, said curing connection medium defining a plurality of mounting connections from said outer frame assembly to said insulating body assembly, said curing connection medium defining a plurality of mounting connections from said inner frame assembly to said insulating body assembly, said outer frame mounting connection comprising said curing connection medium joined in bonding relationship with said mounting bore sidewall, said outer frame mounting connection comprising said curing connection medium joined in bonding relationship with said mounting stud.

11. The element of claim 10, said element further comprising:

said first complementary pattern disposed in unaligned offset relationship to said second complementary pattern to reduce forces in said insulation body assembly from mounting connections with said plurality of mounting studs defined in said front surface and said rear surface.

12. The element of claim 10, said element further comprising:

said inner frame assembly defining an inner frame interior opening disposed in spaced opposed relationship to an inner frame exterior perimeter;

a stop frame assembly extending about said inner frame interior opening, said stop frame assembly stopping said insulating glass unit from moving away from a fixed position in said metal frame assembly.

13. The element of claim 12, said element further comprising:

said stop frame assembly comprising a plurality of adjoined stop frame members anchored in fixed position by said inner frame assembly.

14. The element of claim 13, said element further comprising:

said plurality of adjoined stop frame members each having a truncated triangular cross-sectional shape.

15. The element of claim 10, said element further comprising:

said inner frame assembly defining an inner frame interior opening disposed in spaced opposed relationship to an inner frame exterior perimeter;

said outer frame assembly defining an outer frame interior opening disposed in spaced opposed relationship to an outer frame exterior perimeter;

said inner frame interior opening larger than outer frame interior opening to enable mounting of said insulating glass unit in said metal frame assembly by insertion of said insulating glass unit through said inner frame interior opening.

16. The element of claim 15, said element further comprising:

an outer layer of double-sided adhesive mounting tape affixing said outer frame assembly to said insulating glass unit;

an inner layer of double-sided adhesive mounting tape affixing said inner frame assembly to said insulating glass unit.

17. A system comprising the element of claim 1.

18. A system comprising the element of claim 10.

* * * * *